US005180163A

United States Patent [19]

Lanctot et al.

[11] Patent Number: 5,180,163

[45] Date of Patent: Jan. 19, 1993

[54] BASEBALL BAT

[76] Inventors: Paul A. Lanctot, 520 Sand Hill Rd.; Donald E. Collett, 6001 Butler La., both of Scotts Valley, Calif. 95066

[21] Appl. No.: 815,556

[22] Filed: Dec. 27, 1991

Related U.S. Application Data

[63] Continuation-in-part of Ser. No. 689,010, Apr. 22, 1991, abandoned.

[51] Int. Cl.[5] ..... A63B 59/06

[52] U.S. Cl. ..... 273/72 R; 273/72 A; 273/26 B; 81/22

[58] Field of Search ..... 273/72, 266, 67, 170, 273/736, 73 J; 81/22

[56] References Cited

U.S. PATENT DOCUMENTS

| | | | |
|---|---|---|---|
| 514,420 | 2/1894 | Jacobur | 273/72 R |
| 879,477 | 2/1908 | Kruger | 273/72 R |
| 2,379,006 | 6/1945 | Johnson | 273/72 R |
| 3,578,801 | 5/1971 | Piazza | 273/72 R |
| 4,182,512 | 1/1980 | Kuebler | 273/73 C |
| 4,330,125 | 5/1982 | Sassler | 273/73 C |
| 4,541,631 | 9/1985 | Sasse | 273/170 |

FOREIGN PATENT DOCUMENTS

| | | | |
|---|---|---|---|
| 225938 | 12/1959 | Australia | 273/170 |
| 2106800 | 9/1971 | Fed. Rep. of Germany | 273/735 |

*Primary Examiner*—Mark Graham
*Attorney, Agent, or Firm*—Jeffrey A. Hall

[57] ABSTRACT

A baseball bat (10) made of a rigid material and having an impact portion (12) and a handle portion (13). A tubular member (14) is positioned in the interior of the bat at substantially the handle portion (13) and has a first end (24) and a second end (25), said first end (24) having an opening (28) therein which is removably sealed with a plug (17). A hollow spine member (16) is secured within said tubular member (14) and is preferably attached to said plug (17) and to said second end (25) of the tube member (14). A slurry (15) composed of a plurality of particles (26) and a fluid (27) is disposed within said tubular (14). The tubular member (14) may be secured within said bat by adhesives (30) or by mechanical fastening apparatus.

19 Claims, 3 Drawing Sheets

BASEBALL BAT

This is a continuation-in-part of U.S. application Ser. No. 07/680/010 filed Apr. 22, 1991 now abandoned.

BACKGROUND OF THE INVENTION

1. Field of Invention

This invention relates to ball bats, particularly to baseball bats having means to dampen and isolate shock components generated as a result of the impact when the bat strikes a ball.

2. Description of Prior Art

Baseball bats, racquets, paddles and clubs are all commonly used in various sports where the object is to strike a moving or stationary ball in order to propel it some distance. These devices have certain problems in common as well as common objectives. A primary problem is the generation of a shock as a result of the impact of the ball with the bat, or racquet, or club, etc.

In a baseball bat the shock generated is most severe when the ball impacts a point other than the optimum striking point or "sweet spot" on the bat. The "sweet spot" is the point where the most impact energy will be delivered to the ball and the bat rebounds straight back and opposite to the ball's line of flight, and without any torquing, end for end, as rotation is developed. When this point is missed, some of the impact energy is delivered to the bat, off center, causing the bat to rotate, end for end, which results in both uncomfortable and injurious levels of shock being transmitted through the bat handle to the athlete. At best, this painful shock can rob the athlete of confidence, and at worst, it can cause serious injury.

Heretofore a wide variety of baseball bats have been proposed and implemented which have attempted to dampen such shock and their consequences.

One such bat is disclosed in U.S. Pat. No. 4,951,948 issued to Peng where a cylindrical handle and main body are connected together and held by a retaining collar and an elastic ring. An elastic connector is provided axially attached to an end piece. Such shock absorbing bat did not provide for any relief from end torsional shock which is a primary factor for discomfort and injury, nor did such bat provide relief from the backwards reaction shock without diminution of the forward striking force which is directly and principally involved in propelling the ball.

Another genre of bat is disclosed in U.S. Pat. No. 4,898,386 issued to Anderson, where a training bat consisted of a hollow cylindrical bat having a disk positioned in the interior of the bat near its center. A plate was also positioned in the interior of the bat and an object was slideably positioned in the interior of the bat and was movable between the disk and the plate. A hollow chamber having a knob is positioned at the handle end of the bat. Such bat had limited applications as a training device but was not useful in actual sport, nor did it provide adequate shock dampening functions.

Still another type of bat is disclosed in U.S. Pat. No. 3,955,816 issued to Bratt, where a warm-up bat having a hollow chamber with granular weight material distributed therein to result in a practice ball bat with a distributed weight or batlike feel. The handle section of such bat telescoped into one end of the tubular section filled with an aggregate of flowable material, such as sand. Such bat was not usable in actual sport as it had a deadening effect on the ball, and provided little, if any relief from the shock component responsible for discomfort and injury.

It would be highly desirable therefore to provide a means and method to specifically reduce the destructive shock generated by a bat after striking a ball while leaving the ball propulsion function of the bat essentially unchanged, increase bat speed, and enlarge the "sweet spot" of the bat.

SUMMARY OF THE INVENTION

A baseball bat comprising an elongated body with a free end or impact portion of one diameter tapering to a handle portion of reduced diameter. A tubular member is affixed within said handle portion of said ball bat. The tubular member has a first end and a second end, said first end having an opening therein which is preferably sealed with a removable plug, said second end is preferably closed. A plurality of particles are interiorly disposed within said tubular member and surrounded by a fluid which is also interiorly situated within said tubular member. An elongated spine member is secured within said tubular member and is preferably centrally affixed to the center of the closed end of the tubular member.

The tubular member is preferably cylindrical in shape and may be composed of plastic, metal, rubber, urethane or the like.

The spine member is preferably composed of a soft compliant material which may be a fabric, plastic, rubber, urethane, or the like, so as to readily transfer shock to said particles and said fluid.

The particles may be of any shape, e.g. granular, flakes, particulate, etc., and may be composed of a metal, plastic, composite, or the like. The particles are combined in the tubular member with a viscous fluid, such as oil, and dampen shock components generated when the bat strikes a ball.

The present invention provides a baseball bat and a method of modifying existing baseball bats by use of the above so as to dampen and isolate both the torquing and lengthwise shocks generated by inaccurate hits while having essentially no effect on the third shock component which is perpendicular to the long axis of the bat, and generally concentrated by weight distribution in the impact section of the bat and parallel to the line of flight of the ball Such third shock component, which is substantially unaffected in the instant invention, is primarily a direct consequence of the acceleration of the struck ball and cannot be attenuated without causing a proportional negative effect on the flight of the ball.

In baseball or softball an accurate hit occurs when the bat to ball contact point is directly on what is called, in the sport, "the sweet spot." An engineering term for this point is the radius of gyration. The radius of gyration is the point on a swinging bat which has the average moment of inertia for all components involved in the swinging of the bat. This not only includes the bat, but also a portion of the inertia of the athlete's arms and torso, limited by the rigidity of the athlete's grip. The rotational axis of this moment of inertia is typically through the center of the athlete's body. The precise location of this point is defined by the equation:

$$I/M=K \quad 2$$

Where:

I is the moment of inertia.

M is the mass.

K is the radius of gyration from the axis of rotation.

The radius of gyration is therefore dependent not only on the bat, but also on the way the bat is swung. This virtually assures that shock generated by a hit not on this point or "sweet spot" will be a routine occurrence.

The present invention, by providing a bat having a tubular member having an elongated spine extending therethrough, and having a slurry of particles and fluid therein, said tubular member being securely situated in the handle of the bat, reacts specifically to high amplitude shocks delivered at the handle of the bat and to any shock acting perpendicular to the handle. This device does not adversely affect the flight of the ball as it specifically attenuates the shock which would normally be painfully absorbed by the athlete's hands, wrists and elbows. The device may be retro-fitted onto existing bats or may be simply manufactured as a new bat. Moreover the present invention increases bat speed and creates a larger "sweet spot" while accomplishing the above objectives. In another embodiment of the present invention a weight is added to the handle of the bat which likewise increases bat speed and enlarges the "sweet spot" albeit with a lesser shock absorbing capacity than the preferred embodiment.

Other advantages and a fuller understanding of the invention will be had by referring to the following description and claims of a preferred embodiment thereof taken in conjunction with the accompanying drawings wherein like reference numerals refer to similar parts throughout the several views.

DETAILED DESCRIPTION OF THE PREFERRED EMBODIMENT OF THE INVENTION

Although specific terms are used in the following description for the sake of clarity, these terms are intended only to refer to the particular structure of the invention elected for illustration and are not intended to define or limit the scope of the invention.

Figure 1:
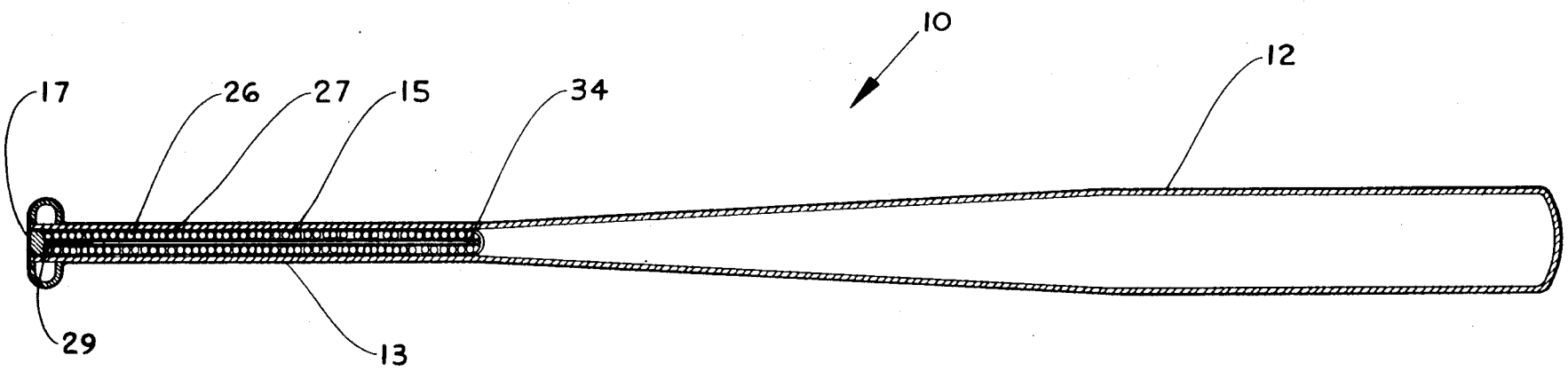
FIG. 1 is a side cross-sectional view of a baseball bat constructed in accordance with the teachings of the present invention.

FIG. 1 shows a baseball bat according to the preferred embodiment of the invention. The bat 10 comprises an elongated body with a free end portion 12 tapering to a handle portion 13 of reduced diameter. A tubular member 14 which is preferably cylindrical in shape and having a first end 24 having an opening 28, and a second end 25 which is preferably closed, is inserted into said handle portion 13 of bat 10. Tubular member 14 is preferably rigidly secured in handle 13 by adhesives 30 and having a cap 34, but may be otherwise. Tubular member 14 preferably extends only into the handle portion 13 of bat 10 for optimal effect. An elongated spine member 16 is secured within tubular member 14. Spine member 16 is preferably centrally secured to said second end 25 of tubular member 14 by adhesives 30 and a compression nipple 29 and centrally to a plug 17 which is used to seal opening 28 of tubular member 14.

Figure 2:
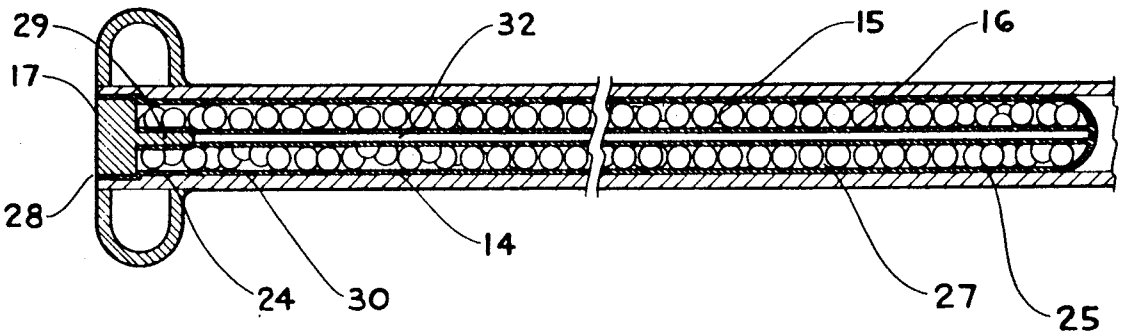
FIG. 2 is an enlarged partial, cross-sectional view corresponding to the handle area of such baseball bat, according to the invention.

Referring to FIG. 2 spine 16 is preferably affixed to plug 17 by compression nipple 29 and adhesives 30. Spine 16 is, in the preferred embodiment, hollow, having space 32 therein. Spine 16 may be composed of rubber, plastic, or any compliant material, but is preferably composed of silicone rubber.

Tube 14 is filled with a slurry 15 composed of a plurality of particles 26 combined with a fluid 27. The plurality of particles 26 may be composed of metal, plastics, composites, or the like, or a combination of such materials, with lead shot being a preferred particle type. The fluid is preferably viscous such as oil, but any flowable liquid may be used as well as "jello-like" compositions. As an alternative embodiment, particles 26 and or spine 16 may be eliminated from tube 14, however, this results in some lessening of the dampening and noise reducing effect of the present invention. Another embodiment encompasses the addition of a weight disposed within the bat handle for increasing bat speed and enlarging the "sweet spot" of the bat.

Figure 4:
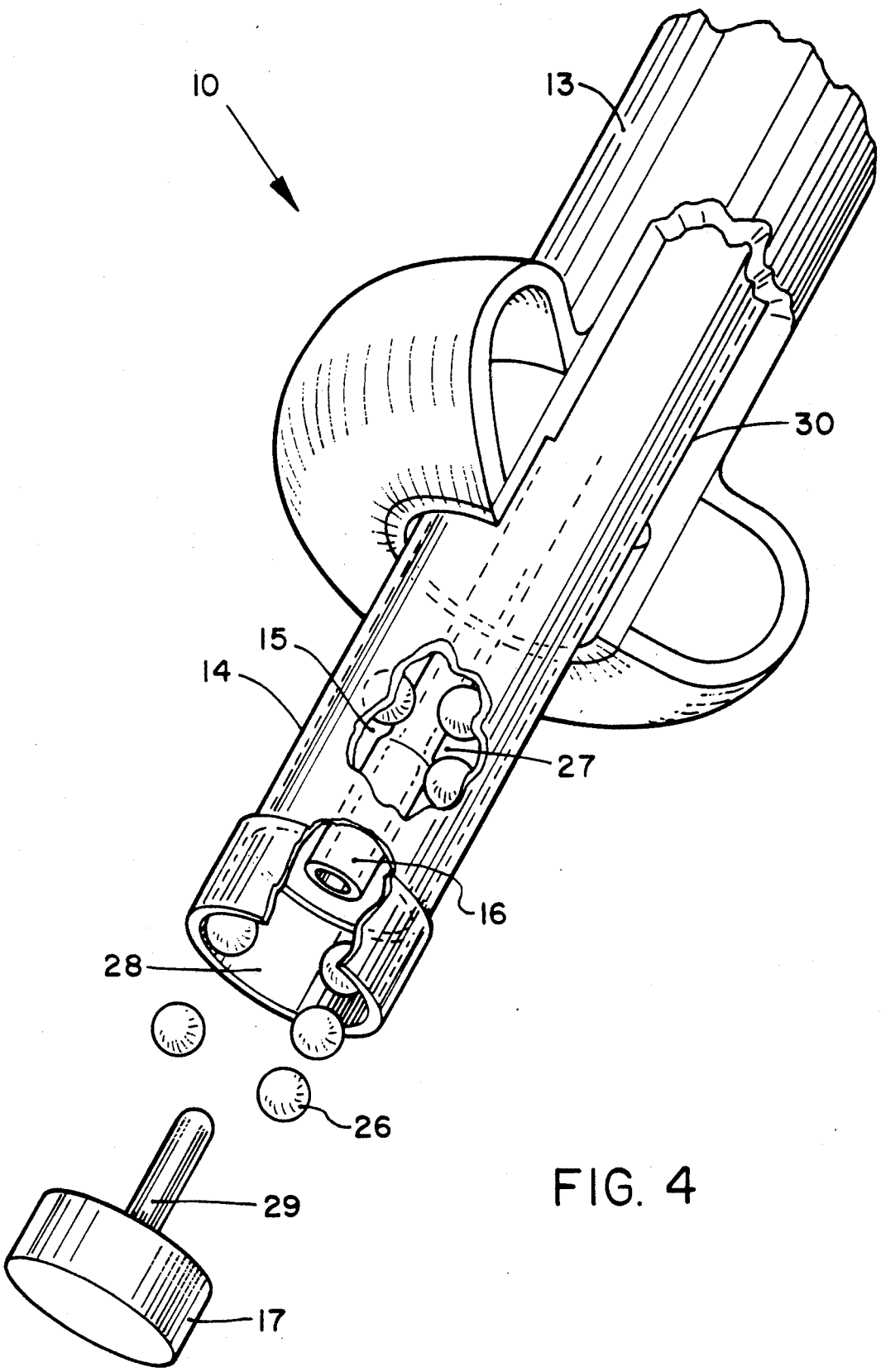
FIG. 4 is a front perspective view of such baseball bat showing the plug, tubular member and spine, partially removed from said bat.

Referring now to FIG. 4, tubular member 14 is shown partially removed from bat 10 and has plug 17 detached to better illustrate tubular member 14, slurry 15, spine 16, and plug 17. As FIG. 4 illustrates, the tubular member 14, slurry 15, spine 16, and plug 17 may be easily retro-fitted onto existing bats or manufactured as part of a new type of bat.

Figure 3:
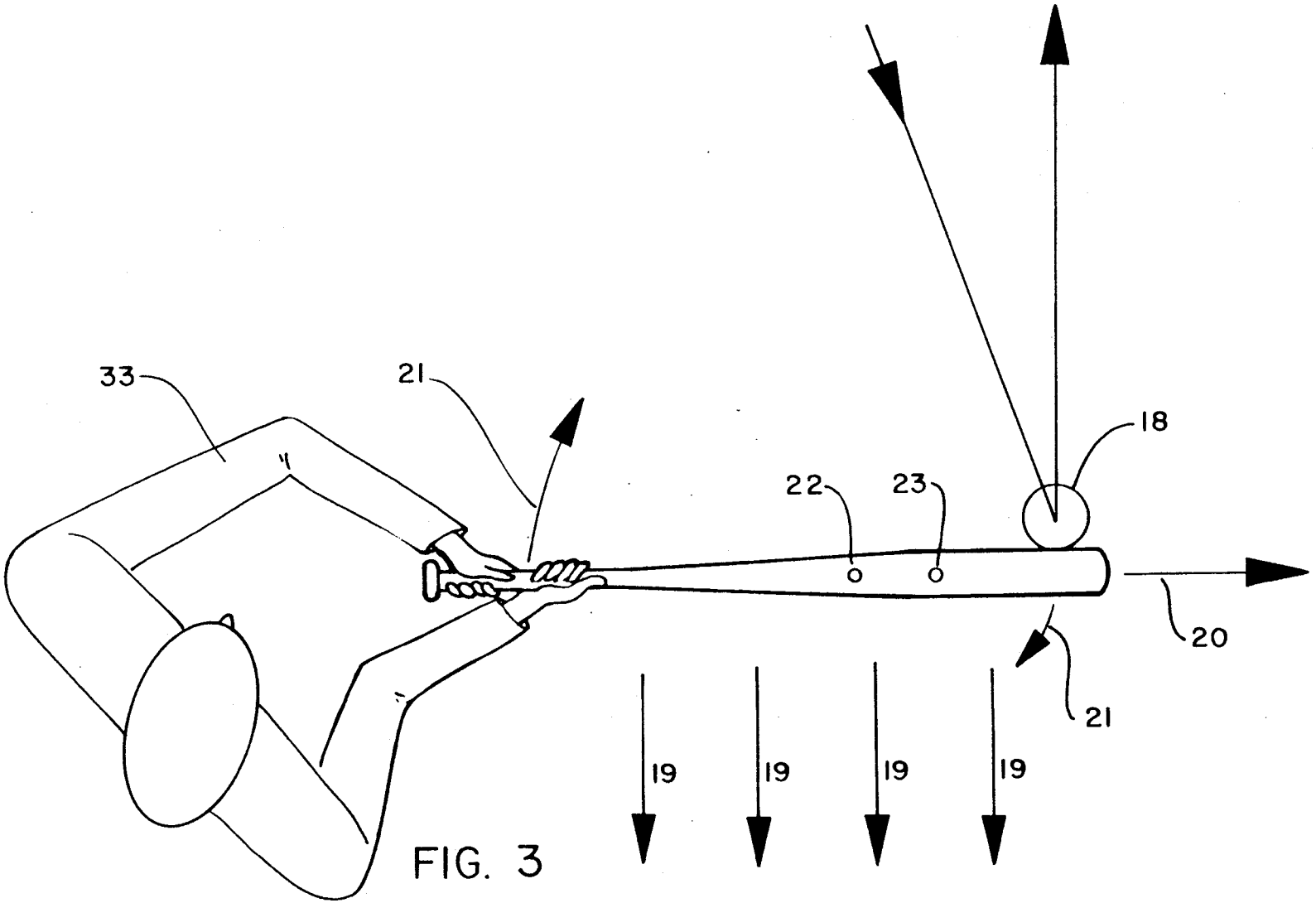
FIG. 3 is a pictorial representation of the forces and balance points associated with a ball striking such baseball bat, according to the invention.

In operation and use, bat 10 is very efficient at dampening shocks produced by inaccurate hits as well as enhancing a wide variety of other batting functions such as bat speed and enlarging the "sweet spot" of the bat. It is believed that such advantages are achieved as herein described, however, no limitations on the scope or breadth of the present invention should be implied therefrom. FIG. 3 illustrates in schematic fashion, an inaccurate impact of bat 10 with a ball 18 held by person 33, which results in a reaction composed of at least three distinct shock components, shock 19 that is essentially parallel to the ball flight and distributed equally along the bat, shock 20 that is parallel to the bat axis, and shock 21 illustrating the torsional or end for end shock component of such inaccurate impact. In general terms, shock 11 causes the bat to rotate rapidly about the bat's center of mass 22 and as the distance from the location of shock 21 to the center of mass 22 may be large in proportion to the distance from handle 13 to center of mass 22, the shock delivered to the handle 13 may be very large.

FIG. 3 further illustrates that shock 21 causes handle 13 to rapidly accelerate in a path essentially at a right angle to the long axis of bat 10. When this occurs, the plurality of particles 26 in slurry 15 move about within tube 14 as the slurry's inertia relative to the accelerating handle 13 provides sufficient force to partially collapse spine 16. The partial collapse of spine 16 allows room for movement of the plurality of particles 26 in fluid 27 of slurry 15. Such movement transfers some of the force of shock 21 over a greater time period than would normally occur without significantly affecting shock 19 which acts in a direction essentially opposite to shock 28 at handle 13, and which is primarily responsible for ball's 18 propulsion. In addition, when the acceleration of handle 13 causes the inside of tube 14 to impact with the plurality of particles 26 in slurry 15, the particles and the fluid transfer of this force is in an essentially random manner since the independent components of the particles careen off of each other and the inner surface of tube 14. This randomization redirects a portion of shock 21 in numerous directions thereby reducing its magnitude in any one direction.

The means and methods herein described for the baseball bat of the present invention may also be installed in any implement subject to torquing shocks, for example, tennis racquets, golf clubs, racquets, carpenter's hammers, and the like. Furthermore, in addition to dampening shock components the present invention increases the speed and "sweet spot" of the implement. In fact, an alternative embodiment encompasses the addition of a weight to the handle of the implement for increasing speed and enlarging the "sweet spot."

While the above description contains many specificities, they should not be construed as limitations on the scope of the invention but merely as exemplifications of preferred embodiments thereof. It is understood that the present disclosure has been made only by way of example and that numerous changes in the details of construction may be resorted to without departing from the spirit and scope of the invention. Accordingly the scope of the invention should be determined by the appended claims and their legal equivalents, and not by the examples which have been given.

We claim:

1. A ball bat comprising:

an elongated body with a free end portion of one diameter tapering to a handle portion of a reduced diameter, a tubular member inserted into said handle portion of said ball bat, the tubular member having a first open end and a second end, said tubular member extending within said handle portion of said elongated body, an elongated spine member secured within said tubular member, a plurality of particles interiorly disposed between said tubular member and the elongated spine member in the handle portion of the tube;

a fluid interiorly situated within said tubular member, and means for sealing said opening in said first end of said tubular member.

2. The ball bat of claim 1 wherein said tubular member is secured within said bat by adhesives.

3. The ball bat of claim 1 wherein said tubular member is composed of metal.

4. The ball bat of claim 1 wherein said elongated spine member is a hollow tube of silicone rubber.

5. The ball bat of claim 1 wherein said elongated spine member is composed of plastic.

6. The ball bat of claim 1 wherein said spine member is centrally secured to said tubular member by a compression nipple and extends lengthwise through said tubular member.

7. The ball bat of claim 1 wherein said plurality of particles are composed of metal.

8. The ball bat of claim 1 wherein said plurality of particles are composed of plastic.

9. The ball bat of claim 1 wherein said plurality of particles are freely flowable.

10. The ball bat of claim 1 wherein said fluid is an oil.

11. The ball bat of claim 1 wherein said means for sealing said opening in said first end of said tubular member comprises a plug.

12. In a baseball bat made of rigid material and having an impact portion and a handle portion with an elongated aperture disposed within the handle portion, the improvement comprising a tubular member inserted into the aperture in the handle portion of the baseball bat, the tubular member having a first open end and a second end, an elongated spine member secured within said tubular member to the second end, a plurality of particles interiorly disposed between said tubular member and said elongated spine member within the handle portion of the bat, a fluid disposed within said tubular member and in contact with said plurality of particles, and means for sealing said opening in said first end of said tubular member.

13. The baseball bat of claim 12 wherein said tubular member is a cylinder of plastic.

14. The baseball bat of claim 13 wherein said tubular member is secured within said bat by adhesives.

15. The baseball bat of claim 12 wherein said spine member is a hollow tube of silicone rubber.

16. The baseball bat of claim 12 wherein said spine member is centrally secured to said tubular member by a compression nipple and extends lengthwise through said tubular member.

17. The baseball bat of claim 12 wherein said plurality of particles are composed of metal.

18. The baseball bat of claim 12 wherein said fluid is an oil.

19. The baseball bat of claim 12 wherein said means for sealing said opening in said first end of said tubular member comprises a plug.

* * * * *